US007749146B2

(12) United States Patent
Burns

(10) Patent No.: US 7,749,146 B2
(45) Date of Patent: Jul. 6, 2010

(54) FITNESS AND REHABILITATION APPARATUS

(76) Inventor: John R. Burns, 1719 Manitoba Ave., South Milwaukee, WI (US) 53172

( * ) Notice: Subject to any disclaimer, the term of this patent is extended or adjusted under 35 U.S.C. 154(b) by 192 days.

(21) Appl. No.: 11/899,546

(22) Filed: Sep. 6, 2007

(65) Prior Publication Data

US 2009/0069729 A1 Mar. 12, 2009

Related U.S. Application Data

(63) Continuation-in-part of application No. 10/097,778, filed on Mar. 14, 2002, now abandoned.

(51) Int. Cl.
*A63B 23/00* (2006.01)

(52) U.S. Cl. ..... 482/148; 601/134; 601/135

(58) Field of Classification Search ..... 482/148, 482/907, 10, 121, 51, 79, 97, 122, 126, 125, 482/139; 601/134–135
See application file for complete search history.

(56) References Cited

U.S. PATENT DOCUMENTS

| | | | | | |
|---|---|---|---|---|---|
| 1,005,791 | A | | 10/1911 | Angell | |
| 1,922,169 | A | | 8/1933 | Martin | |
| 2,022,002 | A | | 11/1935 | Jacks | |
| 3,653,660 | A | | 4/1972 | Malhas | |
| 4,440,391 | A | | 4/1984 | Saenz, Jr. et al. | |
| 4,628,918 | A | * | 12/1986 | Johnson, Jr. | 602/13 |
| 4,641,655 | A | | 2/1987 | Abt | |
| 4,678,108 | A | | 7/1987 | Inman | |
| 4,789,154 | A | | 12/1988 | Mattox | |
| 4,805,619 | A | | 2/1989 | Swearingen | |
| 4,944,289 | A | | 7/1990 | Matthews | |
| 4,974,582 | A | * | 12/1990 | Johnson | 601/134 |
| 5,004,228 | A | | 4/1991 | Powers | |
| 5,244,445 | A | | 9/1993 | Amesquita | |
| 5,498,218 | A | | 3/1996 | Proctor et al. | |
| 5,545,456 | A | | 8/1996 | Suida | |
| 5,634,889 | A | | 6/1997 | Gardner et al. | |
| 5,736,213 | A | | 4/1998 | Meier | |
| 5,787,541 | A | | 8/1998 | Chen | |
| 5,839,996 | A | | 11/1998 | Gooding | |
| 5,879,251 | A | | 3/1999 | Rose | |
| 5,971,947 | A | * | 10/1999 | McNally et al. | 602/62 |
| 6,007,501 | A | * | 12/1999 | Cabados et al. | 601/15 |
| 6,053,881 | A | * | 4/2000 | Boodramsingh et al. | 601/70 |

(Continued)

FOREIGN PATENT DOCUMENTS

| | | |
|---|---|---|
| CH | 642266 | 4/1984 |

(Continued)

*Primary Examiner*—Lori Baker
(74) *Attorney, Agent, or Firm*—Ryan Kromholz & Manion, S.C.

(57) ABSTRACT

A flexible exercising and massaging apparatus formed from tubular, flexible, web-like material and having a plurality of internal pockets, along with an exercise regimen that includes the apparatus. The pockets located at opposite ends of the tubular material may hold objects such as resilient, hand-graspable orbs, including tennis balls, that aid in gripping the apparatus, and which have also been found to be conducive to self-massage therapy. The objects located within an intermediate pocket or pockets may be removed, and alternative objects inserted, through openings that allow access to a preselected pocket or pockets. The openings may be enclosed with resealable fasteners.

20 Claims, 6 Drawing Sheets

U.S. PATENT DOCUMENTS

| | | | | |
|---|---|---|---|---|
| 6,149,555 | A | 11/2000 | Kinback | |
| 6,238,413 | B1 * | 5/2001 | Wexler | 606/204.15 |
| 6,537,308 | B2 | 3/2003 | Burkhart | |
| 6,711,750 | B1 * | 3/2004 | Yoo | 2/338 |
| 2008/0294077 | A1 * | 11/2008 | Walker | 601/135 |
| 2009/0030354 | A1 * | 1/2009 | Ghatge | 601/134 |

FOREIGN PATENT DOCUMENTS

| | | |
|---|---|---|
| FR | 2544990 | 2/1984 |

* cited by examiner

FITNESS AND REHABILITATION APPARATUS

RELATED APPLICATION

The present invention is a continuation-in-part of application, U.S. Ser. No. 10/097,778 filed on 14 Mar. 2002 now abandoned.

BACKGROUND OF THE INVENTION

The present invention relates generally to fitness and rehabilitation devices, and more specifically to a simple, compact stretching and exercise device that can be used by persons of all ages and skills levels to improve athletic performance, reduce recovery time and minimize risk of injury. The device may also be arranged to be used for accupressure and massage therapy.

Exercise helps people live longer and healthier lives. Doctors recommend that people of all ages try to get regular exercise, and to stay active whenever possible. Experts also recommend a warm-up routine before an intense workout and a cool down routine afterward. Both warm-up and cool down routines often include stretching and slow, controlled movements as an intermediary stage between at rest and highly active stages.

Unfortunately, proper exercise techniques can be difficult to practice. The proper stretching forms and techniques that are recommended during a warm up or cool down can be especially difficult to accomplish correctly. Young children may not possess the skill and coordination to stretch properly. Adults engaged in a proper stretching routine often find many of the required bodily positions awkward and difficult to maintain long enough to be effective. Elderly persons often find difficulty in simple stretching techniques. Injured persons in rehabilitation programs may also have similar trouble in accomplishing proper stretching and range of motion exercises.

Therefore, many people utilize an exercising and stretching aid in their fitness routine. Unfortunately, stretching aids are often a simple piece of rope or elastic cord, chosen for low cost and convenience of mobility. When using such nonspecialized equipment, problems can arise for a number of reasons. The cord is rarely the ideal length for the user, as people tend to find an oversized length. To compensate for the added length, users continuously change the location of their grip, which may affect the magnitude of the stretch. The cord may be too thin for the user to form a secure grip, causing the users to wrap the cord around their hand or wrist, which can be uncomfortable and may cause injury. A thin cord will also cause discomfort in the areas of bodily contact, as the pressure around the contact patch will be high. Additionally, the material of the aid may be slippery and difficult to grip or to position on the body, especially during a cool down routine when perspiration is present.

It is important that an exercise or therapy routine be motivational. The present invention and its intended uses have been designed to not only to motivate the user but also to help maintain compliance with a selected or designated exercise or therapy routine.

There are prior art devices that treat specific muscles and specific portions of the body. However, these devices are not designed as devices and products that are versatile and are interactively used by a person. Accordingly, a device is desired that will aid in stretching and exercising that is comfortable and safe to use, while also being inexpensive and easily portable. The device would preferably be comprised of a material capable of absorbing perspiration and be easily washable by machine.

Additionally, many people enjoy the benefits of massage and accupressure therapy, which teaches the application of pressure to known points of the body to treat various ailments. Accupressure may also be used to help the body relax. An ideal time for accupressure and general massage therapy may be after a workout, during a cool down session. It is desirable that a stretching and exercise may also function as a therapeutic massaging apparatus. Thus, the terms "exercise" or "exercising" used throughout the Description and Claims presented herein is intended to include references to fitness and rehabilitation devices and apparatus often recommended for use in the fields of massage and acupressure therapy, or the like.

While prior art devices have been developed to treat various areas of the body, the inventor of the present invention is not aware of any that have been developed for treating the entire body in an active manner. That is, the prior art does not disclose devices that have the versatility for a full-body workout. For example, Johnson, Jr., U.S. Pat. No. 4,628,918 and McNally et al., U.S. Pat. No. 5,971,947 describe devices that wrap around a person's arm to provide pressure on the arm to treat tennis elbow. However, neither of the devices is associated with any other use or movement associated with the body, and the design of each device limits the use of each device to just treating the arm. That is, neither of the devices is arranged for use on other parts of a person's body, such as the back, the neck, or the core sections of the body. Likewise, the devices are not capable of being an integral part of a workout regimen for the entire body.

Other examples of devices that are designed for treatment of a single area of the body include Abt, U.S. Pat. No. 4,641,655 and Swearingen, U.S. Pat. No. 4,805,619. These devices provide cooling wraps that rest upon a person's neck. The devices are not designed for uses on other parts of the body. Likewise, the devices are not for treating, massaging, or exercising any part of the body, as they are intended to sit inertly upon a person's neck so that the neck will be cooled, and also are not capable of being adapted for use in a workout regimen.

Devices have been developed for exercising and treating the neck area. Examples include Mattox, U.S. Pat. No. 4,789,154 and Proctor, U.S. Pat. No. 5,498,216. However, these devices have the same limitations as discussed above with the other prior art, in that the devices are not designed or contemplated to treat other parts of the body except for the specific body part disclosed in the patents.

Thus, it is desired to have a portable exercise device that is capable of treating several areas of the body in a straightforward manner. Further, it is desired that the device will be the basis for a workout regimen that will treat and exercise several aspects of the body, and will do so in a manner that promotes proper form to minimize undue stress or potential injury for a person.

SUMMARY OF THE INVENTION

It is an object of the present invention to provide a stretching and exercise device that is comfortable to use and conveniently portable.

It is another object of the present invention to provide a device capable of absorbing perspiration and that is easily washable.

A further object of the invention is to increase the effectiveness of stretching, flexibility, range of motion, balance and strengthening exercises.

A still further object of the invention is to decrease rehabilitation time and quicken recovery.

Yet another object of the invention is to provide an apparatus that can be used for massage and accupressure therapy.

Yet still another objection is to provide a device that will be incorporated into an exercise routine that is a full body workout routine.

The present invention comprises a web of flexible material formed into a tubular structure. Each tube end is sewn shut, and a number of internal pockets are formed within the tubular structure. Multiple openings are formed along the tube, each allowing access to a preselected internal pocket. Accessible pockets may then receive therapeutic orbs or other internally located objects that may perform various functions, such as to aid in gripping the device. A resealable fastener device, such as hook and loop fasteners, a zipper, snap fasteners, or even common button/button hole fasteners may be used to close each opening. The openings are preferably formed near each end of the tube and in a substantially centrally located portion of the tube. A selected orb, such as a conventional tennis ball, or other resilient object may be inserted into each pocket through the appropriate opening, and the opening is then closed.

The invention can be constructed from any suitable web-like material. The insertable objects can be any type of spherical or non-spherical structure that properly accomplishes the intended purpose of the object; the intended purpose may change according to the location of the pocket in which the object will reside. Some examples are to provide a comfortable gripping means for the user, and to provide pressure to certain points of the user's body. The weight of the elements may vary depending upon the specific use of the apparatus. The overall length of the apparatus may vary depending upon the specialized application or the user. For example a male adult would most likely use a relatively long apparatus, a female adult a medium length apparatus and a child a short apparatus.

The present invention also provides a workout device that will be the main focus of a total workout regimen. That is, the described device will be incorporated into an aerobic workout regimen that will assist the user in warming up, stretching, strengthening, focusing on the core muscles of the body, and provide increased coordination. The workout method uses the advantages of the described device to provide an efficient all-around work regiment for the user.

DETAILED DESCRIPTION

Although the disclosure hereof is detailed and exact to enable those skilled in the art to practice the invention, the physical embodiments herein disclosed merely exemplify the invention, which may be embodied in other specific structure. While the preferred embodiment has been described, the details may be changed without departing from the invention, which is defined by the claims.

Figure 1:
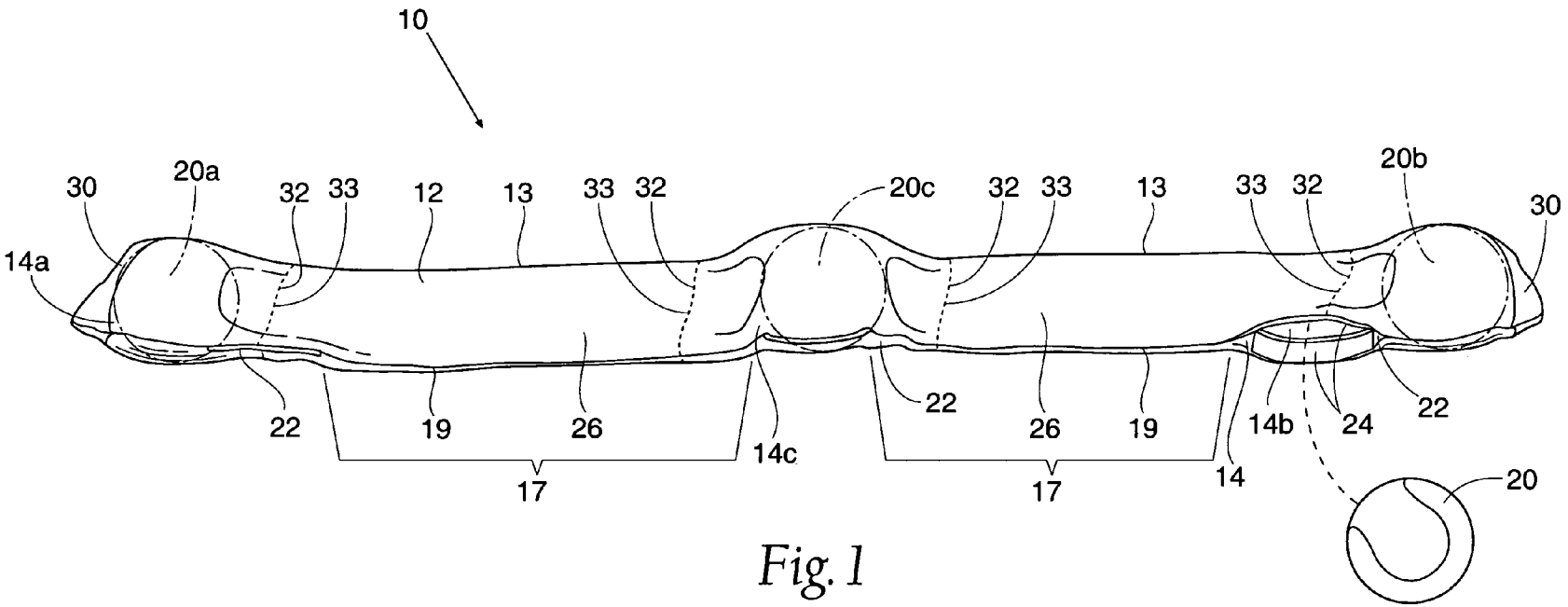
FIG. 1 is a plan view, partially exploded, of an exercise device constructed in accordance with the present invention.
Figure 2:
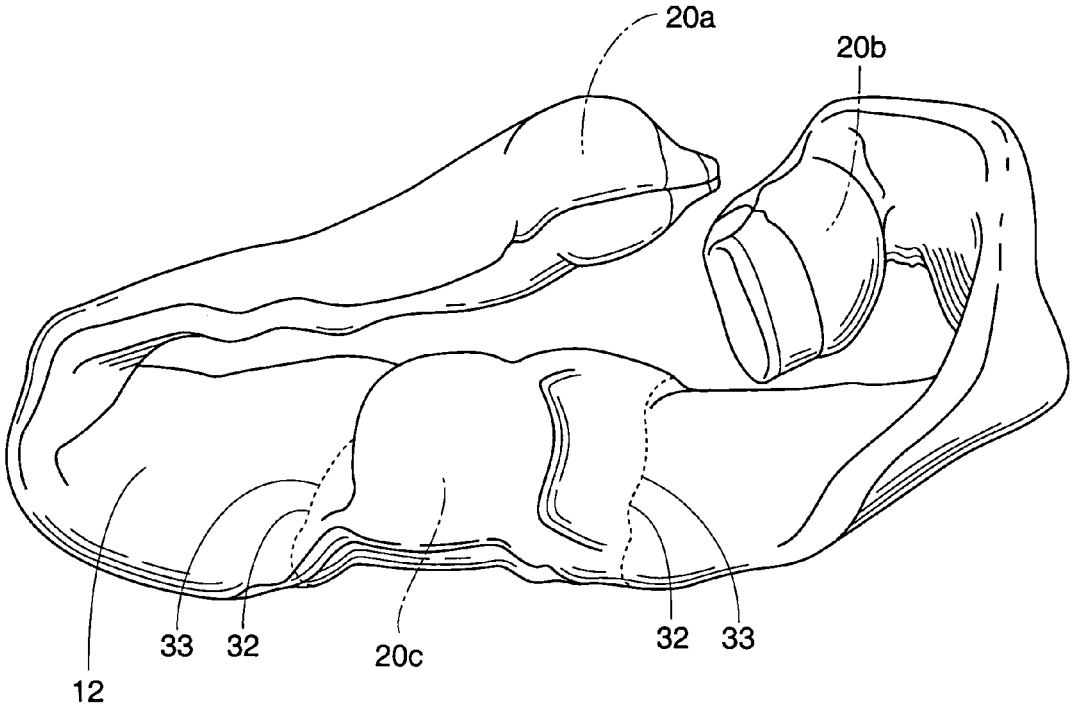
FIG. 2 is a perspective view of the device of FIG. 1.

Referring to FIG. 1, the preferred embodiment 10 of the present invention is depicted. The present invention comprises a substantially tubular structure 12 having at least one internal pocket 14 and at least one internal resilient object 20. As disclosed in the view of FIG. 1, a preferred embodiment utilizes three objects or orbs 20*a*, 20*b* and 20*c*, located in the left end pocket 14*a*, the right end pocket 14*b* and the centrally located pocket 14*c*, respectively. The opening or openings 22 are of a size permitting access of an orb 20*a*, 20*b*, 20*c* to a respective internal pocket 14*a*, 14*b* and 14*c*. The openings 22 may further include resealable fasteners 24 for retaining the resilient object 20 within a respective pocket 14 during use.

The tubular structure 12 may be constructed from any suitable web-like material 26 including, but not limited to, cloth, silk, canvas or mesh. The web-like material 26 is preferably strong but soft, flexible, absorbent and able to provide some amount of friction to aid in grip. The material 26 will preferably be an absorbent material, such as "terry cloth" commonly used in the manufacture of toweling and capable of being washed and dried by machine. The apparatus 10 may be made from a single web 26 folded lengthwise to provide an enclosing crease 13 substantially coextensive with the length of the structure 12. The fold is preferably sewn shut at spaced intervals 17 along the side 19 opposite the crease 13.

The end portions 30 of the tubular structure 12 are closed to provide at least one internal pocket 14 formed within the structure 12. The pockets 14 are each formed by conventional sewing thread stitching 32, or by adhesive or heat fusion techniques to join the facing internal surfaces of the folded web 26 surfaces at longitudinally spaced intervals, and lying transversely relative to the lengthwise crease 13 to defined pocket dividers 32. Various embodiments of the present invention may contain different numbers and arrangements of the internal pockets 14. The preferred embodiment 10 includes three internal pockets 14, including two end pockets 14*a*, 14*b* and a centrally located pocket 14*c*.

Contained within at least one of said internal pockets 14*a*, 14*b*, 14*c* is at least one resilient object or orb 20. The object 20 may serve multiple purposes, such as providing a means of gripping the device and providing a substantially rigid shape that is conducive to massage and accupressure therapy. A preferred object or orb 20 is in the form of a conventional tennis ball.

The primary purpose of the centrally located object 20*c* is to provide a fairly rigid, but flexible localized area to aid in the transfer of pressure to a pressure point region. A secondary function of the centrally located object 20*c* is to provide a gripping area for use when manipulating the invention 10. Although these resilient objects 20 have preferred functions, based on location, each is capable of performing other functions, as well.

Because the preferred function of any given resilient object 20 may change with its location along the length of the tubular structure 12, different objects 20 may be chosen for having different properties. Properties that may affect the choice may be size, shape, hardness, resilience or flexibility. For example, in the preferred embodiment 10, the end objects 20*a* and 20*b* may be fairly large, but somewhat soft, capable of contouring to a user's hand quickly during a given exercise. The central object 20*c* may be a smaller, harder, spherical object that transfers pressure more effectively.

It should be noted that no two objects 20 are required to be substantially alike. The objects 20 may also be custom selected for the individual user. Additionally, individual pockets 14 may or may not contain an object 20. Individual pockets 14 may also contain multiple objects.

The invention preferably utilizes at least one pocket opening 22. Each opening 22 provides reclosable access to an internal pocket 14, and may be located anywhere on the device 10. The openings 22 allow the resilient objects 20 to be removed and exchanged, permitting the device 10 to more easily serve multiple functions. The objects 20 may also be removed while the device 10 is being washed.

Each opening 22 preferably includes a resealable fastener 24 as a means of securing an object, or objects 20 within a respective pocket 14*a*, 14*b*, 14*c* for opening and resealing during use. The resealable fasteners 24 may be of any appropriate type, such as zippers, buttons or snaps. The fasteners 24 will preferably be fairly soft, flexible, and allow an internal connection. The preferred embodiment 10 uses a hook and loop style fastener 24 of the variety commonly known as "VELCRO"®.

Figure 4:
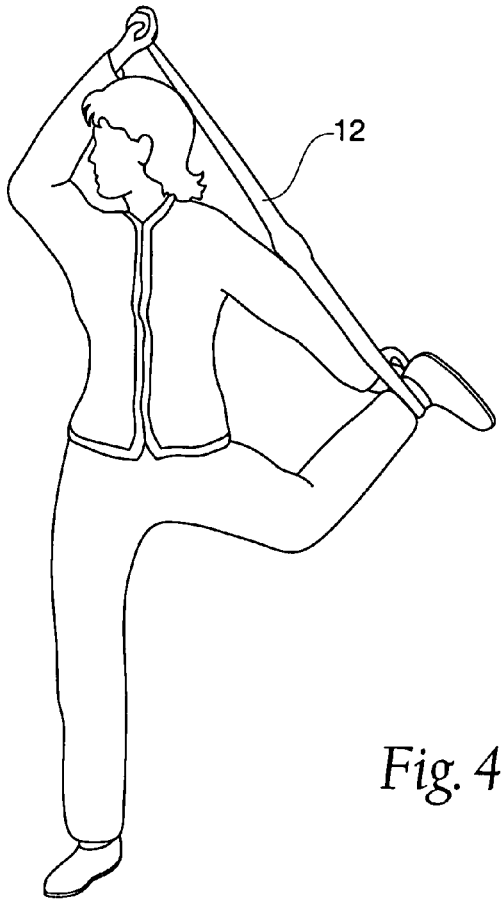
FIG. 4 is an overall perspective view of the present invention when used in connection with a stretching exercise conducted by a user while in a standing position.

Referring to FIG. 4, the device is shown used for a muscle stretching exercising usage. The length of the structure 12 is essential to achieving the proper stretching and motion techniques. Therefore, various users require a structure 12 of various lengths.

Figure 3:
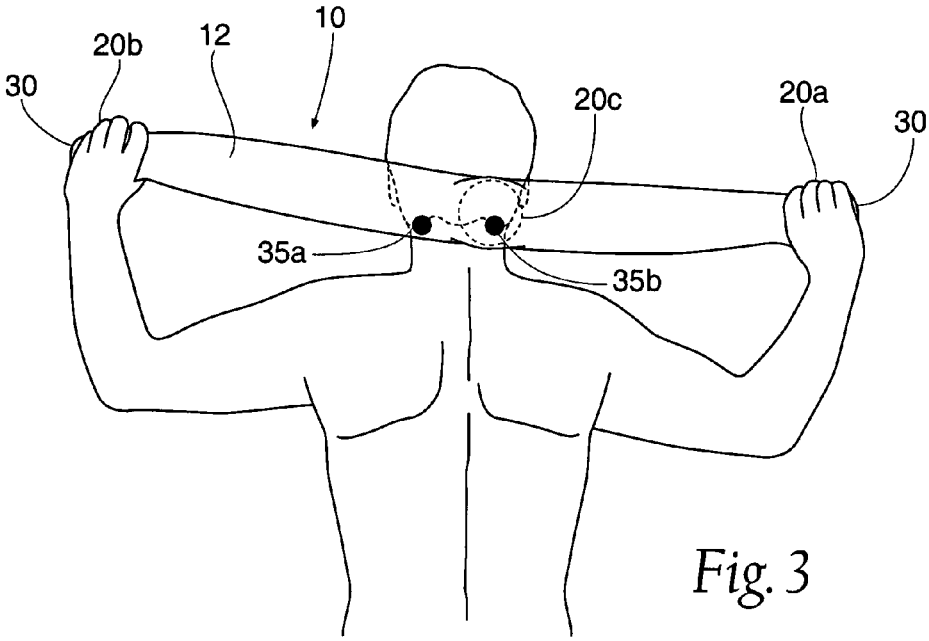
FIG. 3 is an overall perspective view of the present invention illustrating two laterally spaced pressure points on the neck of a user to which an orb may be placed in contact during an acupressure procedure.

As illustrated in FIG. 3, the device 10, including an object 20*c*, provides a useful, and comfortable, acupressure apparatus. As will be observed, a person being treated for headaches or stiff neck, or difficulty turning the head, merely grips the end portions 30, containing orbs 20*a* and 20*b*, and longitudinally stretches the material of the web structure 12 to tighten the area of the orb 20*c* and press the orb 20*c* against a selected acupressure treating area 35*a* or 35*b*, known respectively as "Anmian Points", in the case of treatment for emotional stress which may cause restlessness, tight muscles of the neck, and headaches, or at a centrally located neck muscular area (not specifically shown), commonly known as the "Ashi Point." Acupressure and massage of a respective Anmian or Ashi Point has been found to reduce tense muscles and also helps to soothe stressful emotions.

Another use for the device is rotational exercise techniques. Such techniques are used to strengthen, stabilize and challenge pre-selected muscle groups that are used in various activities. Rotational exercise techniques also increase joint health, muscle flexibility and agility, as well as eye hand coordination. One or more gripping portions of the device are grasped by the user and moved in a predetermined pattern.

Figure 5:
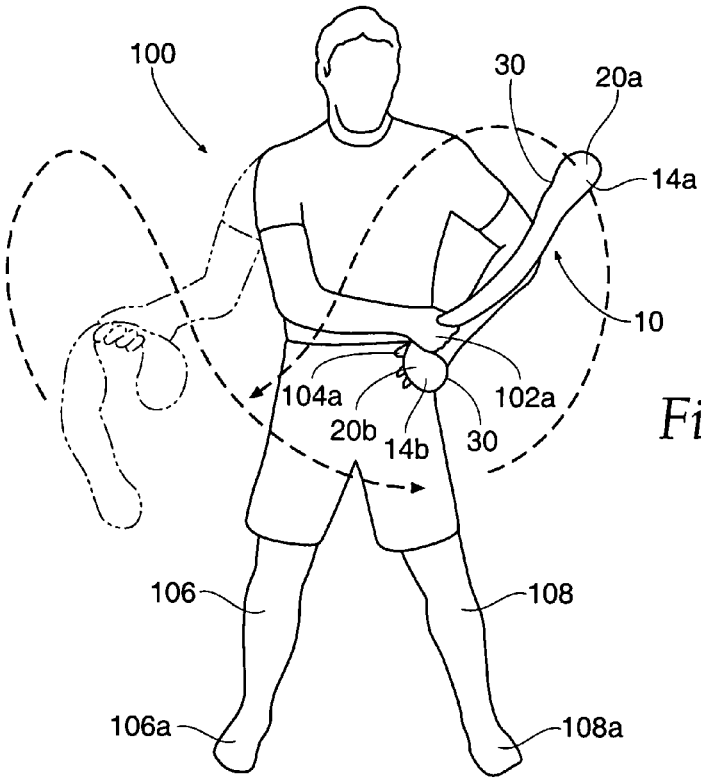
FIG. 5 shows a person employing the exercise device of the present invention for a warm-up exercise.

FIG. 5 demonstrates one of many possible exercise techniques using the device 10. The demonstrated exercise is one of several warm-up exercises incorporated into an exercise routine, with the warm-up exercises lasting about 10-15 minutes. These exercises will warm up the core muscles of the user 100, as well as increase the range of motion of the user 100. The user 100 grasps the device 10 at or near one of the end portions 30 and begins to move the device 10 back and forth across the body in a "figure 8" pattern, which will help in warming up the muscles of the user 100.

Other warm-up movements may be incorporated as well. The user 100 may also decide to switch the device from one hand 102*a* or 104*a* to the other 104*a* or 102*a*, and may also decide to incorporate movement of the legs 106, 108 into the exercises. For instance, the user 100 may decide to pass the device 10 from one hand 102*a* to the other 104*a* underneath one of the user's legs, while lifting that leg 106. The user 100 can incorporate sideways movement of the legs 106, 108 into this movement. Other movements include moving the device 10 around the body while passing it from one hand to the other. Sports style movements, such as practicing a batter's or golfer's swing, can be incorporated into the warm-up. Any of these movements, and other movements, can be used together in various fashions to provide a warm-up routine. Because of the design of the device 10 and the placement of the objects 20*a* and 20*b* within the pouches 14*a* and 14*b*, respectively, the device 10 and the exercises provide enough resistance for the user 100 to have an efficient warm-up routine.

Figure 6:
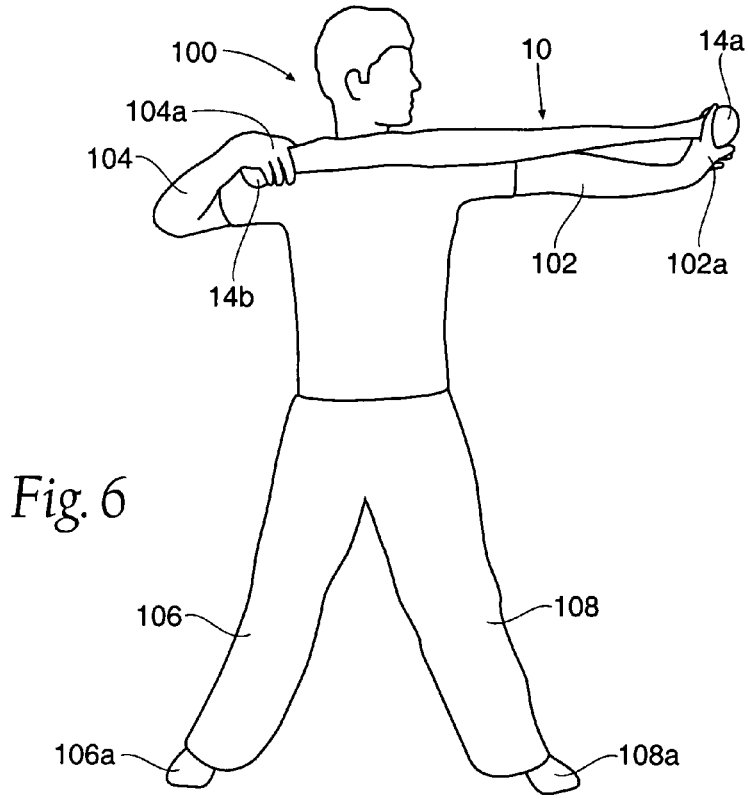
FIG. 6 shows a person employing the exercise device of the present invention for a stretching exercise.

FIG. 6 depicts further exercises for use with the present invention. The user 100 grabs device 10 on or near one of the objects 20*a* or 20*b* with one hand 102*a* and used the other hand 104*a* to grab the device 10 on or near the other object 20*a* or 20*b*. One of the arms is extended outwards in an archer's type of pose, which allows the arm muscles to be properly stretched. The arms can be switched to stretch the other arm, as well. Along with stretching, the opposing, pulling movement of the arms will assist in strengthening the arms 102, 104. The shape and design of the device 10 provides proper length and resistance so that the muscles can be adequately stretched. Likewise, the design of the device 10 allows for the length of the device to be changed to accommodate shorter or taller users. The device 10 can be used for various stretching routines, by grasping one end of the device in one hand and securing and positioning the other end of the device 10 near or with one of the user's other appendages, i.e. the user's other hand or feet. The user 100 will pull the device 10 taut, as necessary, to perform various stretching exercises.

The depicted stretching exercise of FIG. 6 is one of several stretching exercises incorporating the device 10. As an example of another exercise, one of the end portions 30 can be placed under the user's foot 106*a*, while the other end portion 30 will be gripped by the user 100 to stretch the side muscles. Either hand can grip the end portion, in the front or the back of the user 100, to further stretch and twist various muscles, such as the spine muscles. In another example, the device 10 can be gripped with both hands 102*a*, 104*a* behind the back to stretch chest and back muscles. Other standing and kneeling positions can incorporate use of the device 10. Examples of other stretching drills or exercises were previously shown in FIGS. 3 and 4, which can also incorporate using the "Anmian Points" to further provide an overall stretching regime. These stretching exercises can be incorporated into a routine along with the warm-ups demonstrated according to FIG. 5.

Figure 7:
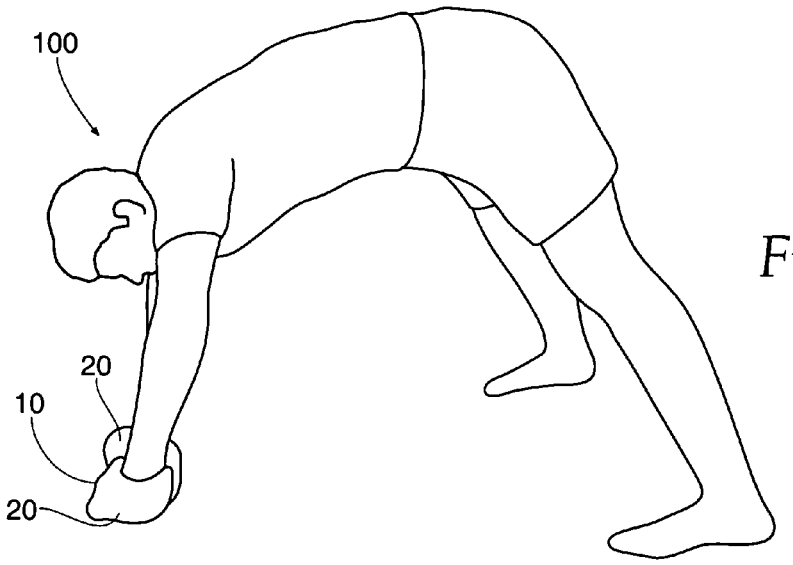
FIG. 7 shows a person employing the exercise device of the present invention for a strengthening exercise.

FIG. 7 depicts further uses of the device 10 that help in strengthening the user's muscles. The user 100 holds the device 10 on a surface and forms a push-up type position. The position specifically shown is sometimes referred to as a "kung fu" push-up. The user 100 balances on the objects 20, which allows the user 100 to perform a push-up that requires more balance than a normal push-up, thereby strengthening the user's muscles. Also, the ability to be able to grasp the objects 20 incorporated in the device 10, as shown, assists the user in keeping the proper spacing when doing the push-ups and other exercises. The objects 20 are preferably ergonomically designed to fit within the user's hands. The user 100 can incorporate other movements, such as leg lifts, into this exercise, to provide a work-out for the entire body. Similarly, the user 100 could perform the push-ups with the knees on the ground, if more comfortable for the user.

Other similar exercises include using the device 10 and the objects 20*b* to lift one's self in the sitting position, with the user's legs either crossed out extended outward. This will assist in strengthening the stomach and related core muscles. Alternatively, the device 10 can be placed behind the neck (see FIG. 3), and sit-ups or crunches can be performed. The sit-ups can incorporate movements, such as rowing movements used with a kayak, or martial art style thrusts, all the while holding the ends portions 30 of the device to provide resistance while performing the basic exercise movements. These strengthening exercises address the muscles of the body together and not in an isolated manner, which strengthens the muscles and the body in an efficient manner.

Figure 8:
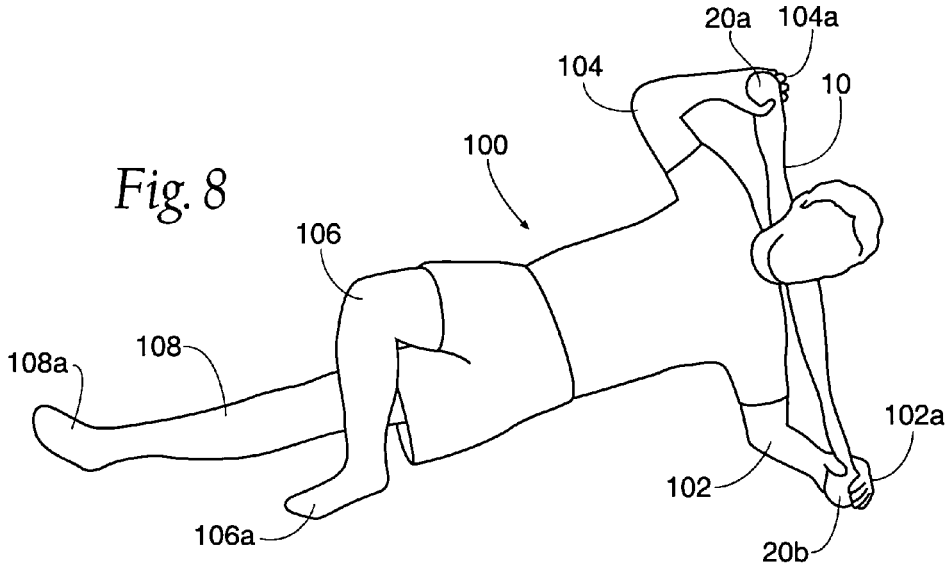
FIG. 8 shows a person employing the exercise device of the present invention to work out the core muscles of the person.

FIG. 8 provides a further exercise that not only strengthens muscles, but treats the core muscles, as well. There are many core muscles, including the abdominal muscles, gluteus muscles, as well as back and abductor muscles. The user 100 stretches the device 10 behind his head, holding the device at the objects 14*a* and 14*b* with a hand 102*a* and 104*a* connected to each of his arms 102 and 104. The user 100 rests on his side, while crossing his legs 106 and 108 and feet 106*a* and 108*a*. The user 100 keeps one hand 102*a* and one foot 106*a* on the floor, while lifting the user's body and leg 108 off of the ground. This will strengthen the core muscles of the user 100.

Other exercises that treat the core muscles include sit-ups and stretches, previously discussed. The device 10 is designed to keep a proper distance between the hands 102*a* and 104*a* when doing the various exercises, which helps in more efficient exercises and, also, less stress on the neck and other parts of the body. Likewise, any of the other described movements, such as the martial arts moves, can be incorporated into these exercises for treating the core muscles. The device 10 and the described exercises provide an easy and efficient workout process that can be tailored to a specific user's needs and abilities, such as using heavier objects 20 for more strenuous activities.

Figure 9:
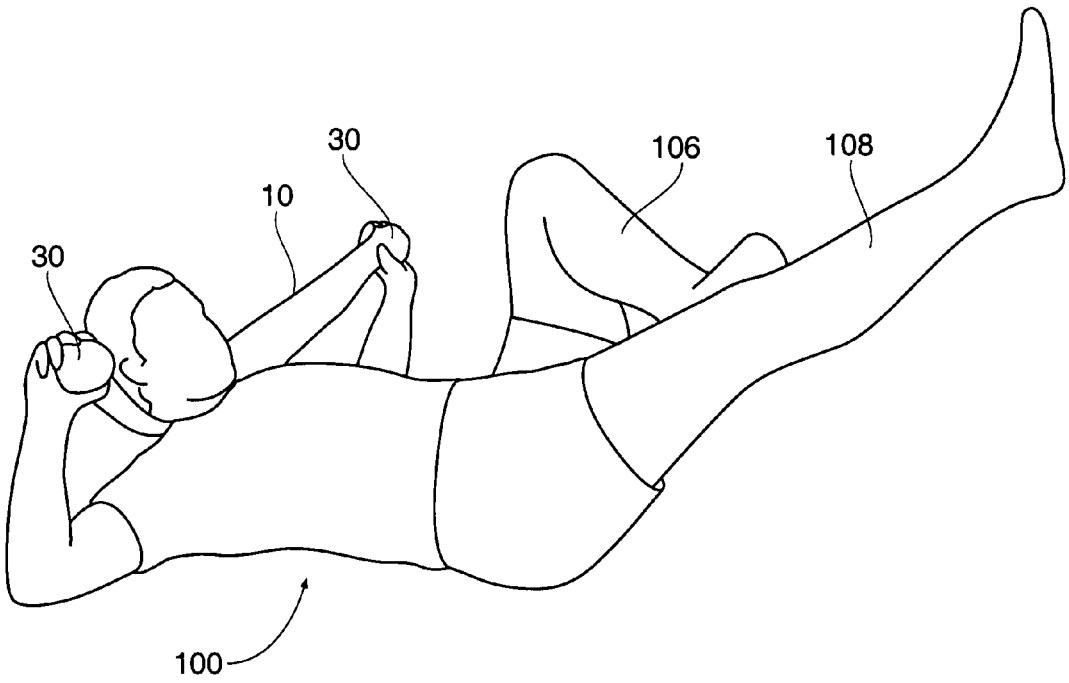
FIG. 9 shows a person employing the exercise device of the present invention during a coordination exercise.

FIG. 9 provides an exercise that will also strengthen the body and treat the core muscles for the user 100. The user 100 is sitting or lying on a surface in a basic sit-up position. As done with several of the exercises, the user 100 grabs the device 10 at each end portion 30 with each of the user's hands 102*a* and 104*a*. The user 100 raises his legs 106 and 108 in the air and can perform sit-ups while moving the legs 106 and 108 inwardly and outwardly from the body or, alternatively, holding the leg 106 in the position of FIG. 9 while performing sit-ups.

The device 10 can also be used to improve the coordination of the user 100. The design and weight of the device 10 allows the user 100 to improve hand-eye coordination. For example, the exercise in FIG. 5 could incorporate a movement, wherein the user 100 twists the device 10 with one hand 102*a* and catches the device with the other hand 104*a*, similar to movements that a martial artist would do when using nunchucks. Other movements, such as rotating the device 10 and stopping the device 10 with a foot 106*a* or 108*a*, would mimic the movements of a soccer player dribbling a ball. These and many other movements will assist the user 100 to gain improved coordination.

It should be noted that the device 10 and method of the present invention incorporates exercises that treat and train the entire body. For example, FIGS. 3-9 demonstrate various exercises that help the user 100 warm-up, stretch, strengthen the user's muscles, as well as treating the core muscles and providing a system for improving coordination. The various exercises are designed to address more than one of these areas of note. For example, the warm-up exercises discussed specifically with respect to FIG. 5, will also address the coordination issues addressed more specifically with respect to FIG. 9. Likewise, the strengthening exercises discussed with respect to FIG. 7 will also address the core muscle groups related to FIG. 8. The present invention provides a device 10 that will easily adapt from one exercise to the next to address all of these concerns quickly and efficiently.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A method of therapeutically, self-applied treatment of muscular aches, pains and stiffness, and wherein an affected muscle underlies a selected epidermal acupressure Ashi Point; said method comprising the steps of:

providing an elongate, substantially tubular structure formed from a web of flexible material, said tubular structure having at least one internal pocket located intermediate the end portions of said tubular structure and containing an independent, spherical, hand-graspable, resilient object within said pocket, and further providing individual internal pockets respectively located at each of the free end portions of the tubular structure, and wherein each of said pockets is peripherally resealable and sized to contain said hand-graspable spherical object;

locating said pocketed resilient spherical object proximate to said Ashi Point;

grasping the free end portions of said tubular structure, each portion containing a hand-graspable object;

stretching said tubular structure while grasping the free ends thereof and in opposed directions away from the location of said intermediate pocketed object to thereby apply pressure to said Ashi Point; and maintaining said pressure for a prescribed time period.

2. The method of claim 1 wherein said intermediate pocketed object is a single resilient, spherical orb.

3. The method of claim 1, wherein said prescribed time period equates to four (4) deep breaths.

4. A portable exercise device comprising:

an elongate, substantially tubular, structure formed from a web of flexible material, said structure having closed ends and a plurality of internal, longitudinally spaced, pockets being located between said closed ends;

a pair of resilient spherical objects, each respective resilient object of said pair of spherical objects being contained within a separate, preselected closed end internal pocket, and being of selected hand-graspable resiliency for physically grasping and stretching the free ends of the tubular structure;

at least one internal pocket being located intermediate the end pockets and being arranged to contain an intermediate object of selected resiliency; and wherein said intermediate object is locatable proximate to and overlying a selected epidermal acupressure Ashi pressure point for therapeutic treatment of a muscular area.

5. The device of claim 4, wherein each pocket contains one of said pair of resilient spherical objects and wherein each pocket further includes a resealable opening.

6. The device of claim 5, wherein at least one of said openings includes resealable means for opening and reclosing each of said pockets.

7. The device of claim 6, wherein said resealable means comprises a hook and loop fastening system.

8. The portable exercise device of claim 4 wherein the intermediate resilient object is of lesser resiliency than the resiliency of the spherical objects located in a respective end pocket.

9. A method of exercising the entire body comprising:

using the device of claim 4 to perform an exercise movement.

10. The method of claim 9 further comprising the steps of:

grasping one of said pockets containing one of said spherical objects; and moving said device in a predetermined pattern.

11. The method of claim 10 further comprising the step of:

moving said device from one hand to the other.

12. The method of claim 10 further comprising the steps of:

grasping a selected one of said closed end pockets containing one of said spherical objects;

grasping the other of said closed end pockets containing the other of said spherical objects;

positioning said tubular structure behind one's back; and performing an exercise movement with said structure behind one's back.

13. The method of claim 9 further comprising the steps of:

grasping one of said end pockets containing one of said spherical objects; and positioning the other end pocket of said tubular structure near another one of the user's appendages; and pulling the structure taut to thereby perform a stretching movement.

14. The method of claim 9 further comprising the steps of:

grasping one of said pockets containing one of said spherical objects;

grasping the other of said pockets containing the other of said spherical objects; and performing an exercise movement.

15. The method of claim 14 wherein said step of performing an exercise movement comprises a push up.

16. The method of claim 14 wherein said step of performing an exercise movement comprises a sit up.

17. The method of claim 14 wherein said step of performing an exercise movement comprises lifting one's body with one's arms.

18. The method of claim 14 wherein said step of performing an exercise movement comprises performing a stretching movement.

19. The method of claim 9 further comprising the steps of:

grasping one of said pockets containing one of said spherical objects;

moving said device around one's body; and passing the device from one hand to the other.

20. The method of claim 9 wherein said exercise movement exercises the core muscles of the user's body.

* * * * *